US005964363A

United States Patent [19]

Kelly et al.

[11] Patent Number: 5,964,363

[45] Date of Patent: Oct. 12, 1999

[54] TAMPER EVIDENT BOTTLE CAP

[75] Inventors: Ronald L. Kelly, Chester, Va.; Michael T. Vavrik, Oak Forest, Ill.; Lino Dreyer, Saint-Louis, France

[73] Assignee: Crown Cork & Seal Technologies Corporation, Alsip, Ill.

[21] Appl. No.: 08/930,646

[22] PCT Filed: Apr. 2, 1996

[86] PCT No.: PCT/EP96/01447

§ 371 Date: Feb. 2, 1998

§ 102(e) Date: Feb. 2, 1998

[87] PCT Pub. No.: WO96/31404

PCT Pub. Date: Oct. 10, 1996

Related U.S. Application Data

[63] Continuation of application No. 08/616,524, Mar. 19, 1996, abandoned.

[30] Foreign Application Priority Data

Apr. 5, 1995 [CH] Switzerland ..... 977/953

[51] Int. Cl.[6] ..... B65D 41/34

[52] U.S. Cl. ..... 215/252

[58] Field of Search ..... 215/252, 256, 215/258

[56] References Cited

U.S. PATENT DOCUMENTS

| | | | |
|---|---|---|---|
| 3,737,064 | 6/1973 | Patel et al. . | |
| 4,147,268 | 4/1979 | Patel et al. . | |
| 4,346,811 | 8/1982 | Hilaire . | |
| 4,457,438 | 7/1984 | Varlet et al. . | |
| 4,461,390 | 7/1984 | Csaszar . | |
| 4,470,513 | 9/1984 | Ostrowsky . | |
| 4,529,096 | 7/1985 | Chartier et al. . | |
| 4,550,844 | 11/1985 | Lininger . | |
| 4,664,278 | 5/1987 | Barriac . | |
| 4,709,824 | 12/1987 | Thompson . | |
| 4,919,285 | 4/1990 | Roof et al. . | |
| 5,273,173 | 12/1993 | Debetencourt | 215/252 |
| 5,443,171 | 8/1995 | Sprowl . | |
| 5,472,106 | 12/1995 | Nofer . | |
| B1 4,919,285 | 8/1991 | Roof et al. . | |

FOREIGN PATENT DOCUMENTS

| | | |
|---|---|---|
| 0 004 500 | 7/1982 | European Pat. Off. . |
| 0 228 618 | 7/1987 | European Pat. Off. . |
| 32 24 002 | 12/1983 | Germany . |

*Primary Examiner*—Stephen K. Cronin
*Assistant Examiner*—Nathan Newhouse
*Attorney, Agent, or Firm*—Woodcock Washburn Kurtz Mackiewicz & Norris LLP

[57] ABSTRACT

A compression failure resistant tamper evident bottle cap includes a skirt with a lower edge, and a tamper-evident band formed integrally with the skirt and having structure for engaging beneath a retaining flange on the bottle so as to prevent subsequent withdrawal of the band. Frangible bridges connect the band to the lower edge of the skirt. To prevent destruction of the bridges as the cap is forced onto the bottle during installation, the skirt has one or more tabs or the like, extending downward over a portion of the band, for preventing undue diametral expansion of the tamper evident band as it passes over the retaining flange.

1 Claim, 5 Drawing Sheets

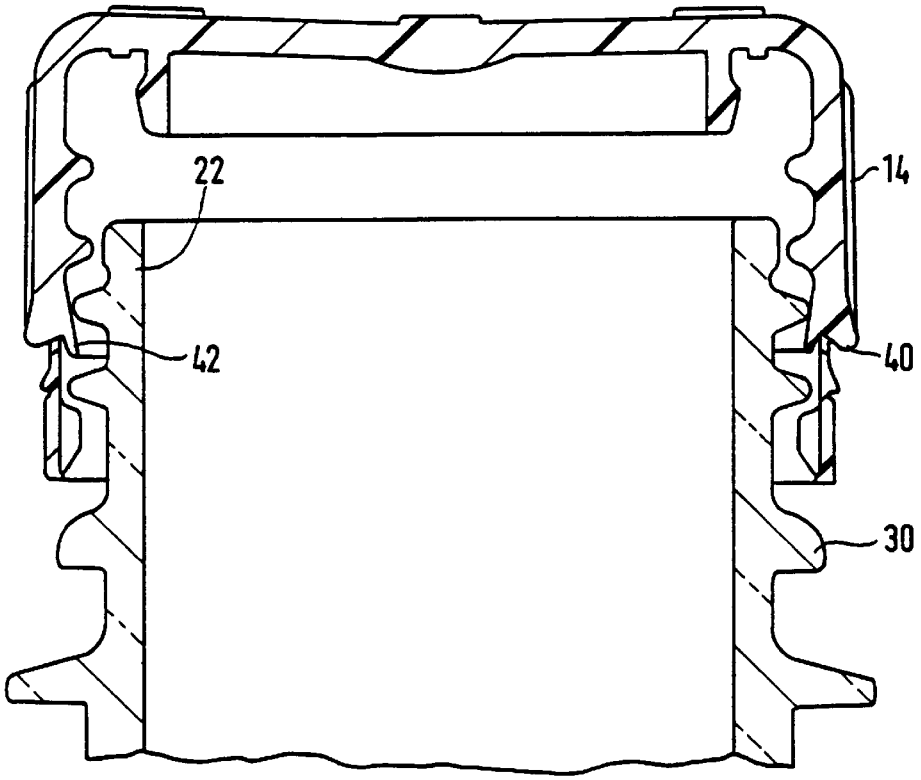
FIG.10
FIG.11
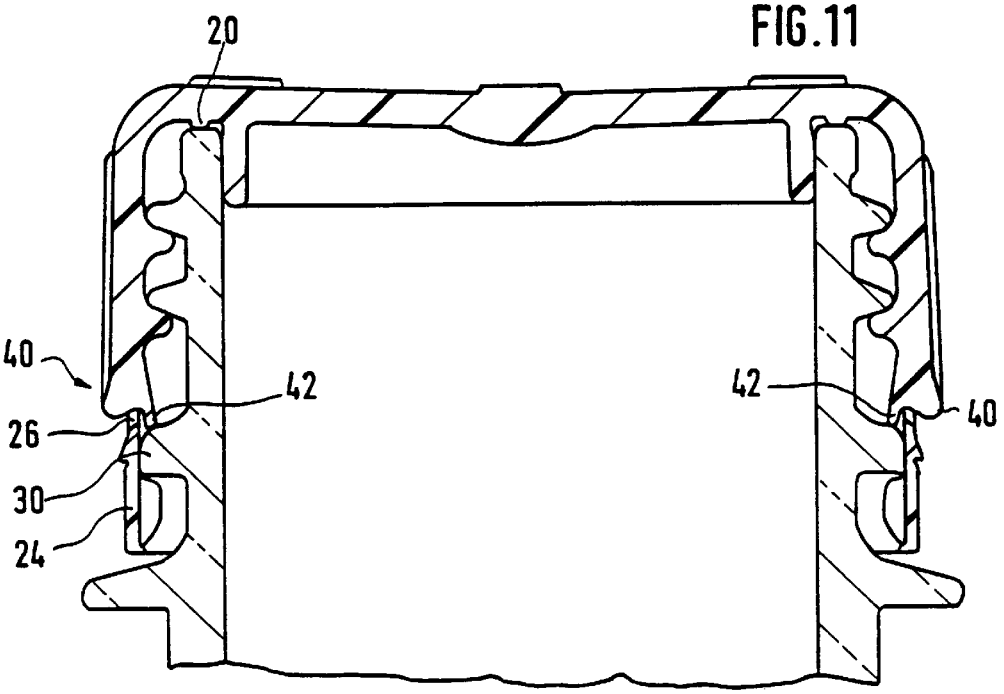

TAMPER EVIDENT BOTTLE CAP

This application is a continuation of U.S. Ser. No. 08/616,524, filed Mar. 19, 1996, now abandoned

BACKGROUND OF THE INVENTION

This invention relates to the art of bottle closures, and more particularly to a compression failure resistant tamper evident bottle cap.

Nowadays, many bottle caps have a band which tears away from the rest of the cap, remaining with the bottle neck, when the cap is removed for the first time. One can visually, or by feel, detect when such a cap has been removed and then reinstalled, because of the failure of the anti-tamper feature. Such caps, once made of metal, now are usually molded from a plastic polymer.

The tamper-evident band is normally smaller in diameter than a retaining flange on the bottle finish, and is pushed over the retaining flange at the factory when the cap is installed. The band is connected to the rest of the cap along a weakened peripheral line, for example define by a series of perforations which weaken the material and provide a locus for failure when the cap is removed.

A problem with some caps of this type is that during installation, as the band is being forced over the bottle's retaining flange, the resistance force not only puts large axial compression forces on the weakened peripheral line: it also expands the band radially. The combination of these two factors gives rise to the possibility that the band will tend to ride up over (around) the bottom of the cap, failing the tamper-evident features-prematurely.

EP228618A2 discloses a tamper-indicating closure comprising means for preventing undue diametral expansion of the tamper-evident band. The tamper-evident band is provided with inwardly and upwardly directed protrusions on its upper edge. During relative axial movement between the tamper-evident band and the skirt of the closure, these projections engage the bottom edge of the skirt of the closure. The protrusions comprise an inclined upper and outer surface. When this surface engages the lower edge of the skirt, the tamper-evident band is prevented from unduly expanding. Such means, however, need a separate cutting operation for their fabrication and work only if there is a relative axial movement between the tamper-evident band and the skirt of the closure. This axial movement may lead to premature failure of frangible bridges connecting the tamper-evident band to the skirt.

SUMMARY OF THE INVENTION

An object of the invention is to reinforce a bottle cap having a tamper-evident band against axial compression failure as described above.

This and other objectives of the invention are achieved by the invention described below. According to this invention, a compression failure resistant tamper evident bottle cap is formed, including a skirt with a lower edge, and a tamper-evident band formed integrally with the skirt and having structure for engaging beneath a retaining flange on the bottle so as to prevent subsequent withdrawal of the band. Frangible bridges connect the band to the lower edge of the skirt. To prevent destruction of the bridges as the cap is forced onto the bottle during installation, the skirt has one or more tabs or the like, extending downward over a portion of the band, for preventing undue diametral expansion of the tamper-evident band as it passes over the retaining flange.

BRIEF DESCRIPTION OF THE DRAWINGS

In the accompanying drawings,

FIG. 10 is a view like FIG. 4, of a fourth embodiment of the invention; and FIG. 11 is a view like FIG. 10, showing the cap partially removed from the bottle.

DESCRIPTION OF THE PREFERRED EMBODIMENT

Figure 1:
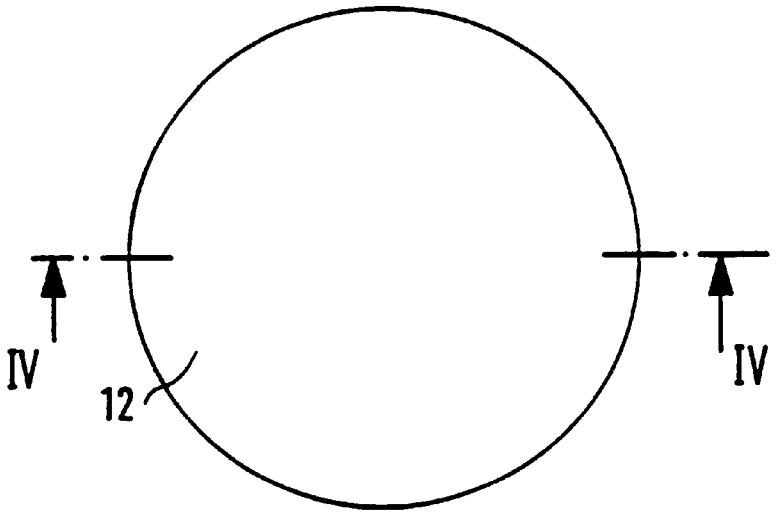
FIG. 1 is a top plan view of a compression failure resistant tamper evident bottle cap embodying the invention.
Figure 2:
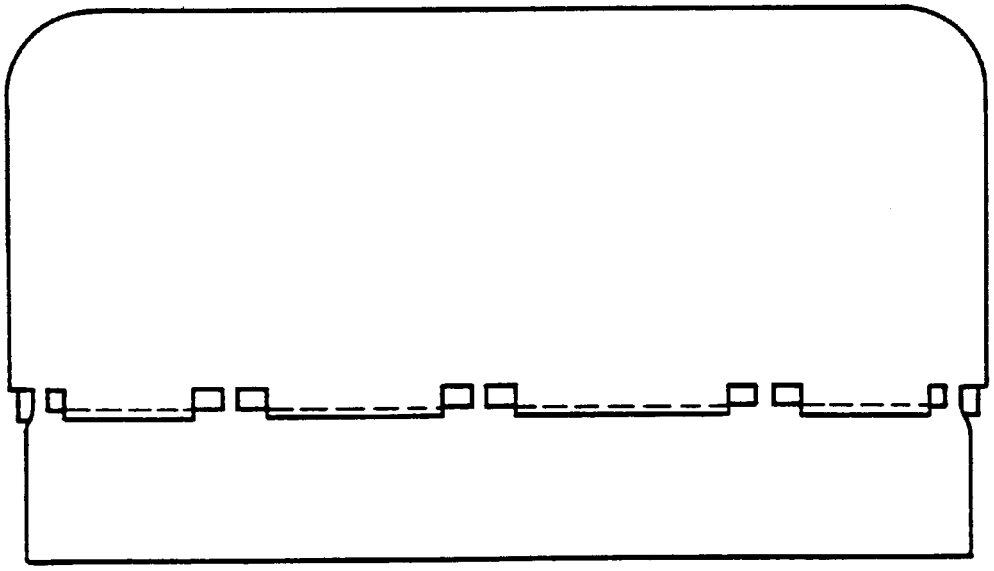
FIG. 2 is a side elevation thereof.

A compression failure resistant tamper evident bottle cap embodying the invention is shown in FIGS. 1–7. The cap has a number of conventional features, including a planar, circular base 12 surrounded by a circular skirt 14 having a helical internal thread 16 for engaging a complementary thread 16 (see FIG. 7) on a bottle neck 18. The circular rib 20 on the bottom of the base provides a seal within the bottle mouth 22 when the cap is in place.

Figure 4:
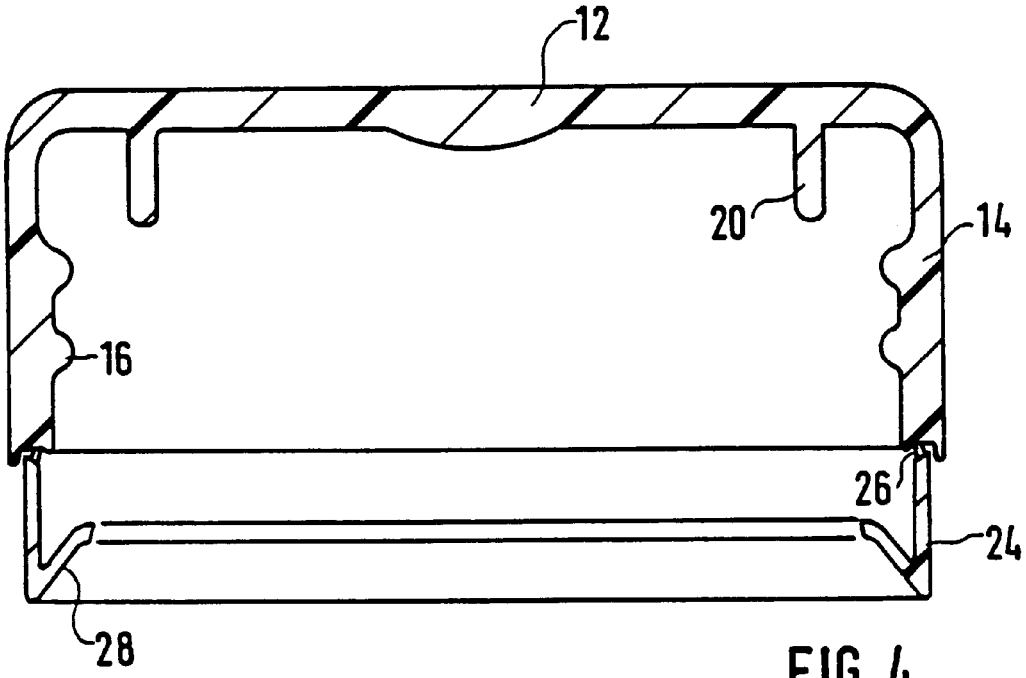
FIG. 4 is a sectional view taken on the plane 4—4 in FIG. 1, with a portion of the bottle finish added.
Figure 7:
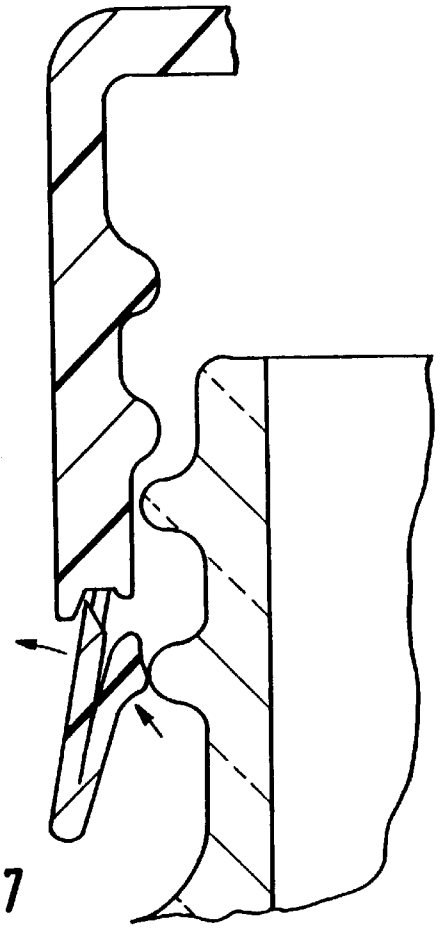
FIG. 7 shows the bottle cap being installed onto a bottle.
Figure 6:
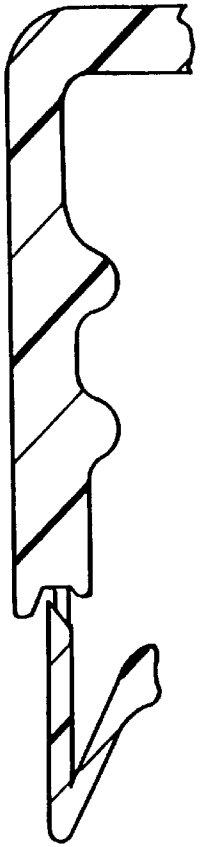
FIG. 6 is a similar detail, apart from the bottle finish.
Figure 5:
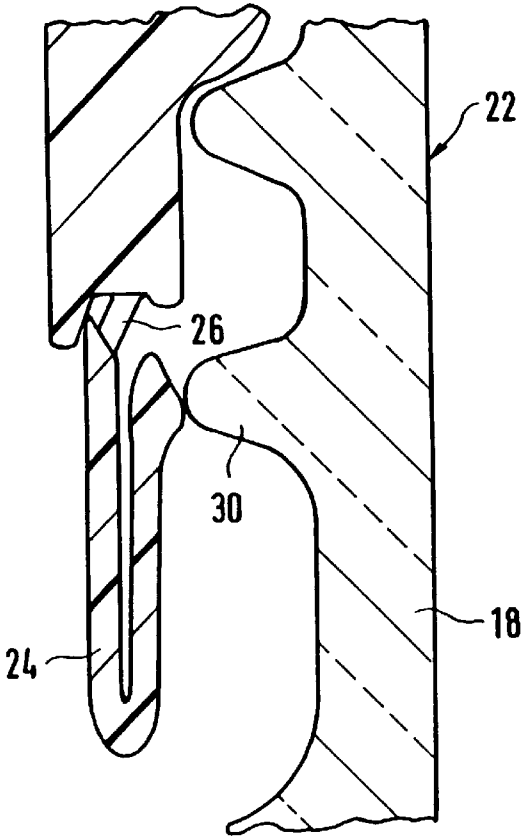
FIG. 5 is a detail of a portion of FIG. 4.

FIGS. 4 and 5 show the tamper-evident band 24 which is connected to the bottom of the skirt by a series of frangible bridges 26 designed to fail when the cap is removed from the bottle. However, the bridges must not fail when the cap is installed on the bottle at the factory, or they will give a false indication of tampering.

In FIG. 5, one can see the cap being installed on a bottle, the internal circumferential frusto-conical sleeve 28 being pushed outward as its free edge passes over the external flange 30 on the bottle neck. The bottom of the flange has a 20 steep pressure angle, greater than the angle of repose for the two materials in combination, so that the band remains captured as the cap is removed, by a retention force greater than that needed to break the bridges.

One can see, in FIG. 5, that the tamper evident band is expanded diametrally during installation, so that the bridges gain an oblique orientation. At the same time, the band experiences axial resistance to being forced over the bottle flange. These two factors combine to encourage continued flexure of the bridges, which in extreme cases can result in the band tending to ride up over (outside) the skirt, breaking the bridges.

Now, according to this invention, the amount of bridge flexure during installation is limited by providing, on the bottom edge of the skirt, structure which limits outward expansion of the band, and brings the skirt to bear directly down on the band, so that the bridges are not unduly stressed.

This protective structure may take a number of forms. The one presently most preferred is that shown in the first seven figures. In this embodiment, the skirt has a series of tabs 32 which extend downwardly, radially containing the uppermost part of the band. The windows 34 between the tabs are centered over the bridges, permitting one to see the bridges, and also facilitating manufacture. One can clearly see the function of the tabs in FIGS. 5 and 7, where they are preventing undue outward movement of the band during 10 installation. At all other times, the tabs are out of contact with the band, the only connection then being the bridges.

Figure 8:
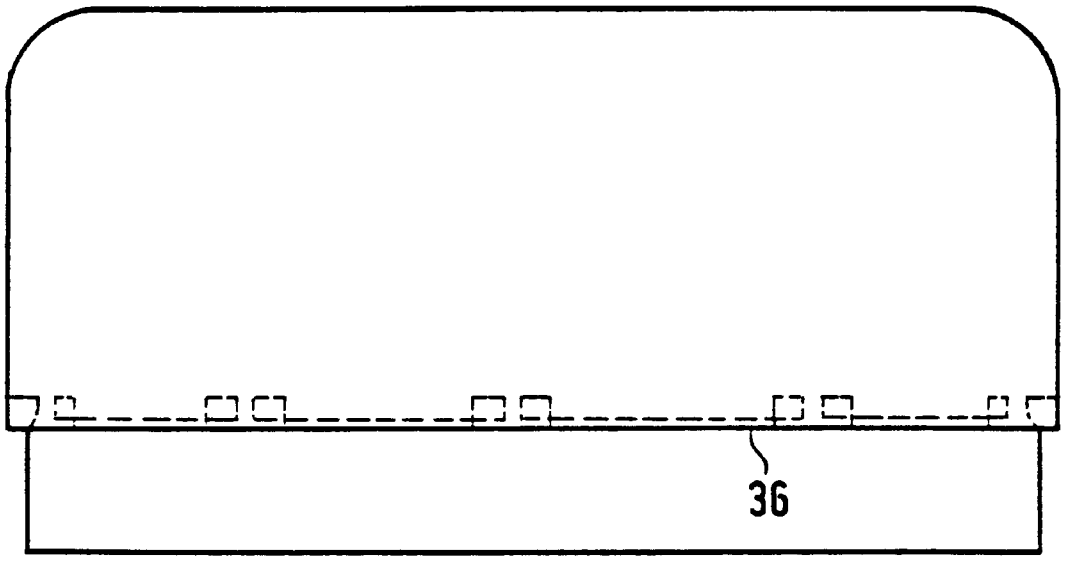
FIG. 8 is a view like FIG. 2, of a second embodiment of the invention.

FIG. 8 shows a modified form of the invention, which is the same in all respects as that previously described, except the there are no windows: the tabs are replaced by a continuous circular rim 36 which performs the same function as the tabs, perhaps with some added strength, but with the disadvantage that the bridges are hidden from view.

Figure 9:
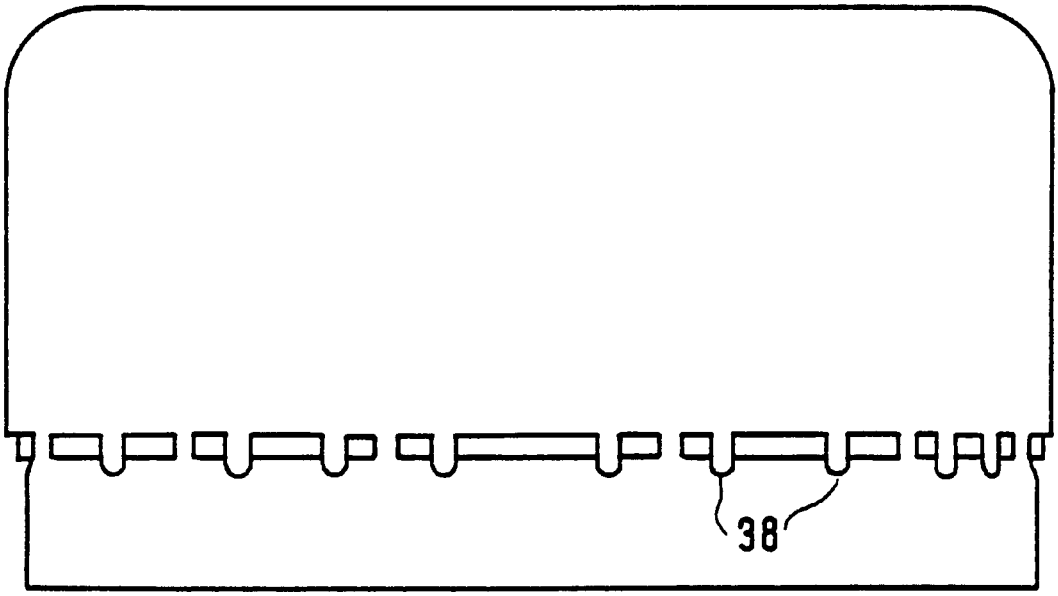
FIG. 9 is a view like FIG. 2, of a third embodiment of the invention.

In the embodiment of FIG. 9, the tabs have been replaced by much narrower, more numerous lugs 38 which again keep the band from expanding too much during installation.

In FIGS. 10 and 11, the expansion-limiting structure 40 is, as in FIG. 8, continuous, but axially abbreviated, so that one can still see the bridges. The internal lip 42 depicted provides a sealing function not important to the present invention.

In each embodiment of the invention, the expansion-limited structure at the bottom of the cap's skirt prevents the band from riding up over the cap during installation, and thus maintains the integrity of the bridges.

Figure 3:
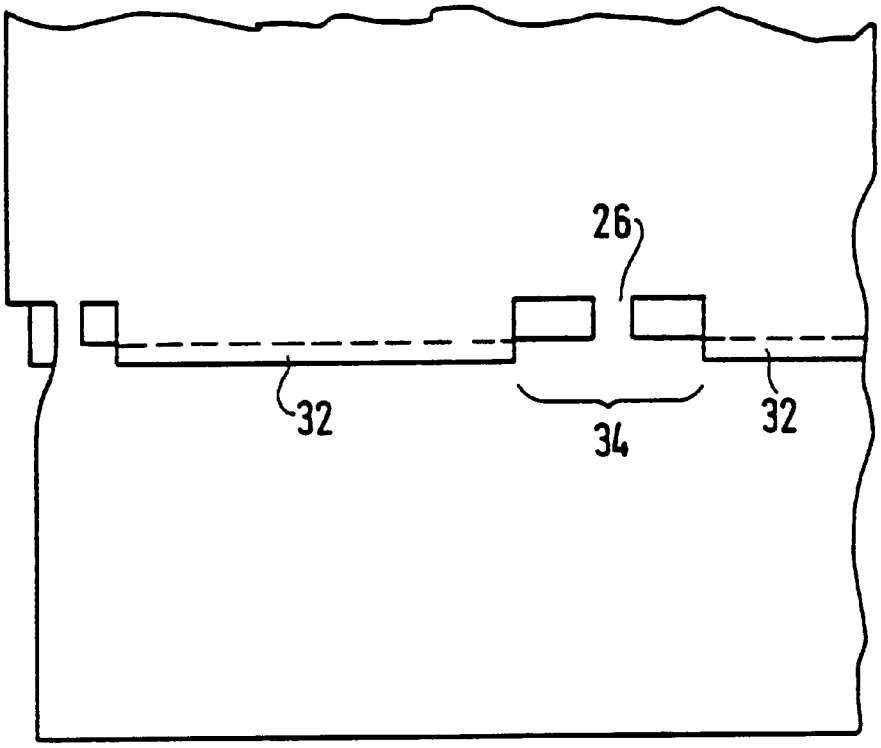
FIG. 3 is a detail of a portion of FIG. 2.

It may be noted that the bridges can be replaced by functional equivalents. For example, a circumferentially continuous thin connector strip, or a score line, might connect the band to the skirt. The bridges might be fairly narrow, circumferentially, as shown in FIG. 3, or they might have substantially width. Conceivably, they could be defined between a series of perforations in the cap material. Other variations may occur to people in this field.

Since the invention is subject to modifications and variations, it is intended that the foregoing description and the accompanying drawings shall be interpreted as only illustrative of the invention defined by the following claims.

We claim:

1. A compression failure resistant tamper evident bottle cap for installation on a bottle having a retaining flange, said cap comprising, a skirt having a lower edge;

a tamper evident band having an outer surface an upper edge and a lower edge, and formed integrally with the skirt and having means for engaging beneath the retaining flange so as to prevent removal of the band from the bottle;

frangible means for connecting the band to the lower edge of the skirt, said frangible means being a series of bridges molded at circumferential intervals between the skirt and the band; and means for preventing undue diametrical expansion of the tamper evident band as the cap is being installed on the bottle;

said expansion preventing means comprising a plurality of tabs extending downwardly from the lower edge of the skirt to a point above the lower edge of the tamper-evident band, and a plurality of windows between the tabs, said windows being centered over the bridges so that all the bridges are visible between the tabs, such that the tabs substantially contact the outer surface of the upper edge of the tamper evident band during installation of said cap on said bottle, thereby providing restraining engagement of the tamper evident band to protect the structural integrity of the frangible means.

* * * * *